US007926280B2

(12) United States Patent
Morenko et al.

(10) Patent No.: US 7,926,280 B2
(45) Date of Patent: Apr. 19, 2011

(54) INTERFACE BETWEEN A COMBUSTOR AND FUEL NOZZLE

(75) Inventors: Oleg Morenko, Oakville (CA); Kenneth Parkman, Georgetown (CA); Stephen Phillips, Toronto (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 1007 days.

(21) Appl. No.: 11/749,375

(22) Filed: May 16, 2007

(65) Prior Publication Data

US 2008/0282703 A1 Nov. 20, 2008

(51) Int. Cl.
*F02C 1/00* (2006.01)
*F02G 3/00* (2006.01)

(52) U.S. Cl. ..... 60/740; 60/800; 60/796

(58) Field of Classification Search ..... 60/737, 60/740, 742, 746, 747, 748, 734, 752–760, 60/804, 796, 799, 800
See application file for complete search history.

(56) References Cited

U.S. PATENT DOCUMENTS

| | | | | |
|---|---|---|---|---|
| 3,939,653 | A | 2/1976 | Schirmer | |
| 4,195,476 | A | 4/1980 | Wood | |
| 4,322,945 | A | 4/1982 | Peterson et al. | |
| 4,365,470 | A | 12/1982 | Matthews et al. | |
| 4,454,711 | A | 6/1984 | Ben-Porat | |
| 4,606,190 | A | 8/1986 | Greene et al. | |
| 4,686,823 | A | 8/1987 | Coburn et al. | |
| 4,748,806 | A | 6/1988 | Drobny | |
| 4,999,996 | A | 3/1991 | Duchene et al. | |
| 5,117,624 | A | 6/1992 | Roberts, Jr. et al. | |
| 5,172,545 | A * | 12/1992 | Forestier | 60/800 |
| 5,220,786 | A | 6/1993 | Campbell | |
| 5,222,358 | A * | 6/1993 | Chaput et al. | 60/796 |
| 5,253,471 | A | 10/1993 | Richardson | |
| 5,265,409 | A | 11/1993 | Smith, Jr. et al. | |
| 5,271,219 | A | 12/1993 | Richardson | |
| 5,274,991 | A | 1/1994 | Fitts | |
| 5,323,601 | A | 6/1994 | Jarrell et al. | |
| 5,435,139 | A | 7/1995 | Pidcock et al. | |
| 5,501,071 | A | 3/1996 | Ansart et al. | |
| 5,509,270 | A | 4/1996 | Pearce et al. | |
| 5,758,503 | A | 6/1998 | DuBell et al. | |
| 5,894,732 | A | 4/1999 | Kwan | |
| 5,916,142 | A | 6/1999 | Snyder et al. | |
| 5,924,288 | A | 7/1999 | Fortuna et al. | |
| 5,956,955 | A * | 9/1999 | Schmid | 60/748 |
| 5,974,805 | A | 11/1999 | Allen | |
| 5,996,335 | A | 12/1999 | Ebel | |
| 6,351,949 | B1 | 3/2002 | Rice et al. | |
| 6,427,435 | B1 | 8/2002 | Patterson et al. | |
| 6,453,675 | B1 | 9/2002 | Royle | |
| 6,497,105 | B1 * | 12/2002 | Stastny | 60/796 |
| 6,679,063 | B2 * | 1/2004 | Ebel | 60/798 |
| 6,880,341 | B2 * | 4/2005 | Parkman et al. | 60/740 |
| 7,140,189 | B2 * | 11/2006 | Markarian et al. | 60/796 |
| 7,478,534 | B2 * | 1/2009 | Guezengar et al. | 60/796 |
| 7,690,207 | B2 * | 4/2010 | Markarian et al. | 60/796 |
| 7,748,221 | B2 * | 7/2010 | Patel et al. | 60/752 |
| 2009/0000303 | A1 * | 1/2009 | Patel et al. | 60/752 |

OTHER PUBLICATIONS

U.S. Appl. No. 11/588,339, filed Oct. 2006, Markarian et al.

* cited by examiner

*Primary Examiner* — William H Rodríguez
(74) *Attorney, Agent, or Firm* — Ogilvy Renault LLP

(57) ABSTRACT

A floating collar assembly is provided comprising a substantially flat floating collar trapped between a heat shield and a dome panel of the combustor. Axial engagement between the floating collar and the fuel nozzle is maintained via a nozzle cap mounted over the fuel nozzle tip.

16 Claims, 3 Drawing Sheets

INTERFACE BETWEEN A COMBUSTOR AND FUEL NOZZLE

TECHNICAL FIELD

The invention relates generally to gas turbine engine combustors and, more particularly, to a floating collar arrangement therefor.

BACKGROUND OF THE ART

Gas turbine combustors are typically provided with floating collar assemblies or seals to permit relative radial or lateral motion between the combustor and the fuel nozzle while minimizing leakage therebetween. The collar typically has an L-shaped cross-section with an axial component for sliding engagement with the fuel nozzle and a radial component for sealing engagement with the dome panel. The radial component of the collar is typically axially trapped between a bracket welded to the dome panel and a retaining plate. Manufacturing and assembly of such floating collar assemblies is a relatively time consuming process which necessitates pressing of the collar competent into an L-shaped part. Also, this design requires some mechanical adjustment to maintain a uniform gap between the floating collar and the retaining plate.

Accordingly, there is a need to provide a solution which addresses these and other limitations of the prior art.

SUMMARY OF THE INVENTION

In one aspect, there is provided a floating collar and combustor arrangement for receiving a fuel nozzle, comprising: a combustor having an opening defined in a dome thereof for receiving the fuel nozzle, the combustor having an inner surface and an outer surface; a heat shield mounted to said dome inside said combustor at a distance from said inner surface, a floating collar axially trapped between the heat shield and the inner surface of the combustor such that relative axial movement is substantially restrained but relative radial movement is permitted, the floating collar having a central aperture substantially aligned with the opening in the dome; and a nozzle cap adapted to be mounted on said fuel nozzle for providing an axial interlace between the floating collar and the fuel nozzle, the nozzle cap being axially moveable in said central aperture of said floating collar.

In another aspect, there is provided a floating collar assembly for providing an interface between a fuel nozzle and a gas turbine engine combustor, the combustor having a dome and a heat shield mounted thereto, the dome defining a nozzle opening for receiving the fuel nozzle, the assembly comprising a floating collar adapted to be sandwiched between the dome and the heat shield for limited radial sliding movement with respect thereto, the floating collar defining an aperture substantially aligned with the nozzle opening when the floating collar is mounted between the heat shield and the dome, and a nozzle cap adapted to be mounted to the fuel nozzle, said floating collar being axially slidably engaged on said nozzle cap to permit relative movement between the fuel nozzle and the floating collar while providing sealing therebetween.

In a further aspect, there is provided a floating collar arrangement for providing a sealing interface between a gas turbine engine combustor and a fuel nozzle tip, the combustor having a dome and a heat shield mounted thereto, the dome defining an opening for receiving the fuel nozzle tip, the arrangement comprising an axially extending cylindrical surface provided at the fuel nozzle tip, said axially extending cylindrical surface being insertable though the opening in the dome, and a substantially flat washer-like floating collar sealingly engaged on said axially extending cylindrical surface for relative axial movement with respect thereto when said substantially flat washer-like floating collar is trapped between the heat shield and the dome.

In a still further general aspect, there is provided a method of mounting a floating collar assembly to a combustor having a dome panel and a heat shield mounted to the dome panel, the method comprising: axially trapping a floating collar between the heat shield and the dome panel of the combustor such as to substantially restrained axial movement of the floating collar while allowing relative radial movement, and inserting a fuel nozzle tough the floating collar, the fuel nozzle having an axially extending peripheral surface having a length selected to maintain sealing engagement between the fuel nozzle and the floating collar when relative axial movement occurs between the fuel nozzle and the floating collar due to thermal expansion/contraction.

DESCRIPTION OF THE DRAWINGS

FIG. 3 is an exploded view of the floating collar arrangement shown in FIG. 2.

DETAILED DESCRIPTION OF PREFERRED EMBODIMENTS

Figure 1:
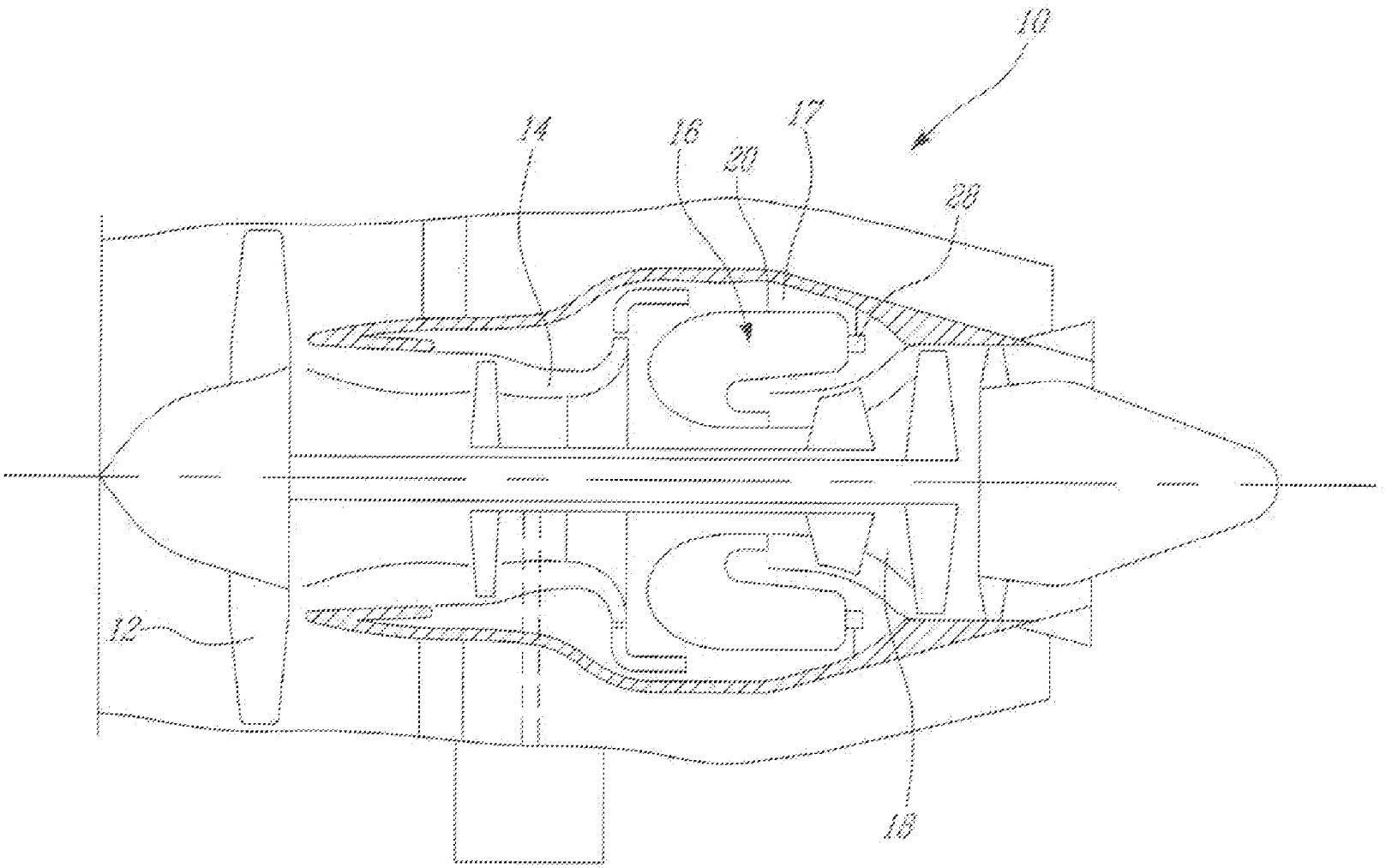
FIG. 1 is a schematic longitudinal cross-sectional view of a turbofan engine having a reverse flow annular combustor.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
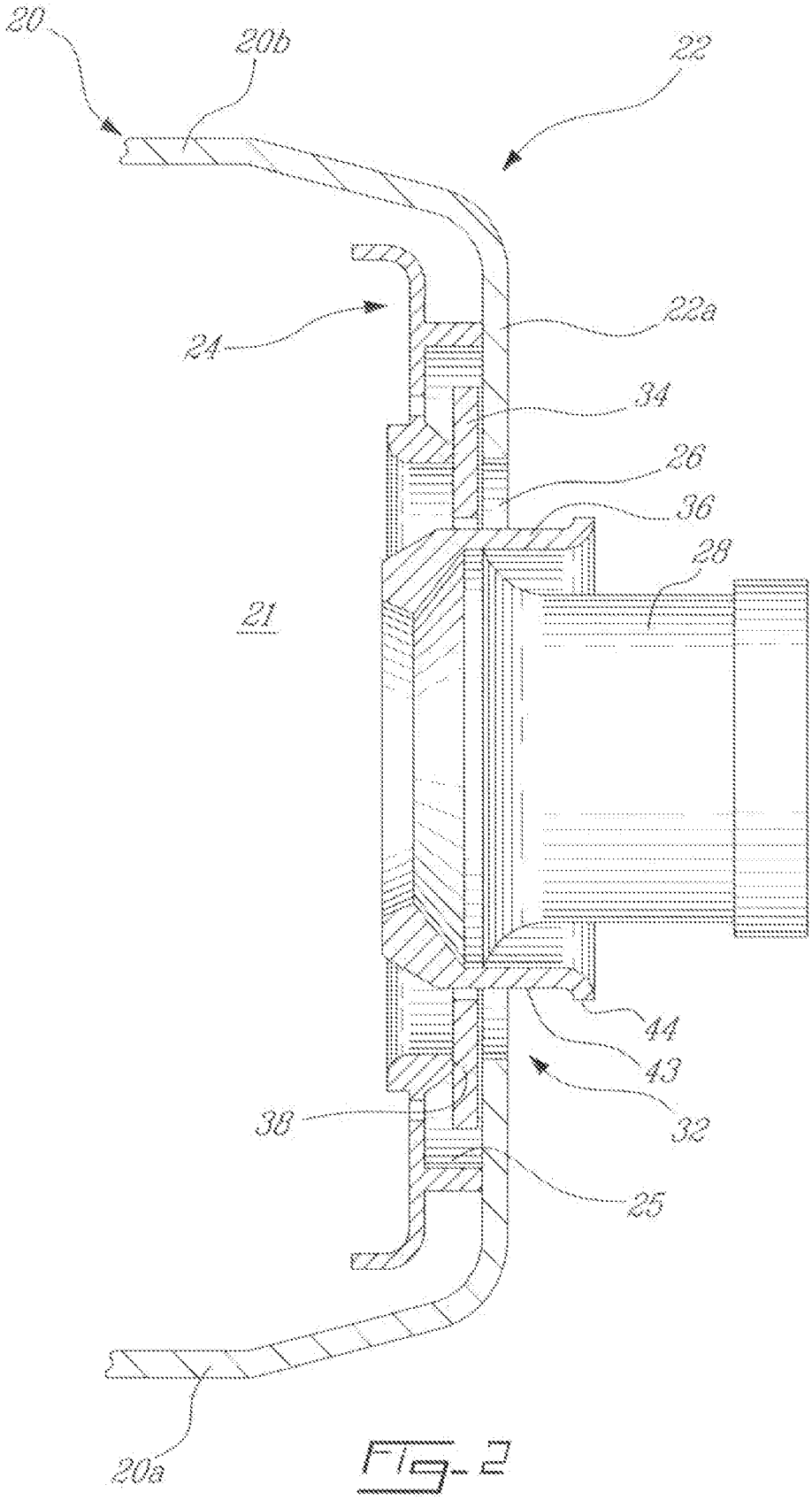
FIG. 2 is an enlarged cross-sectional view of a dome portion of the combustor, illustrating a floating collar arrangement between a fuel nozzle and the combustor.
Figure 5:
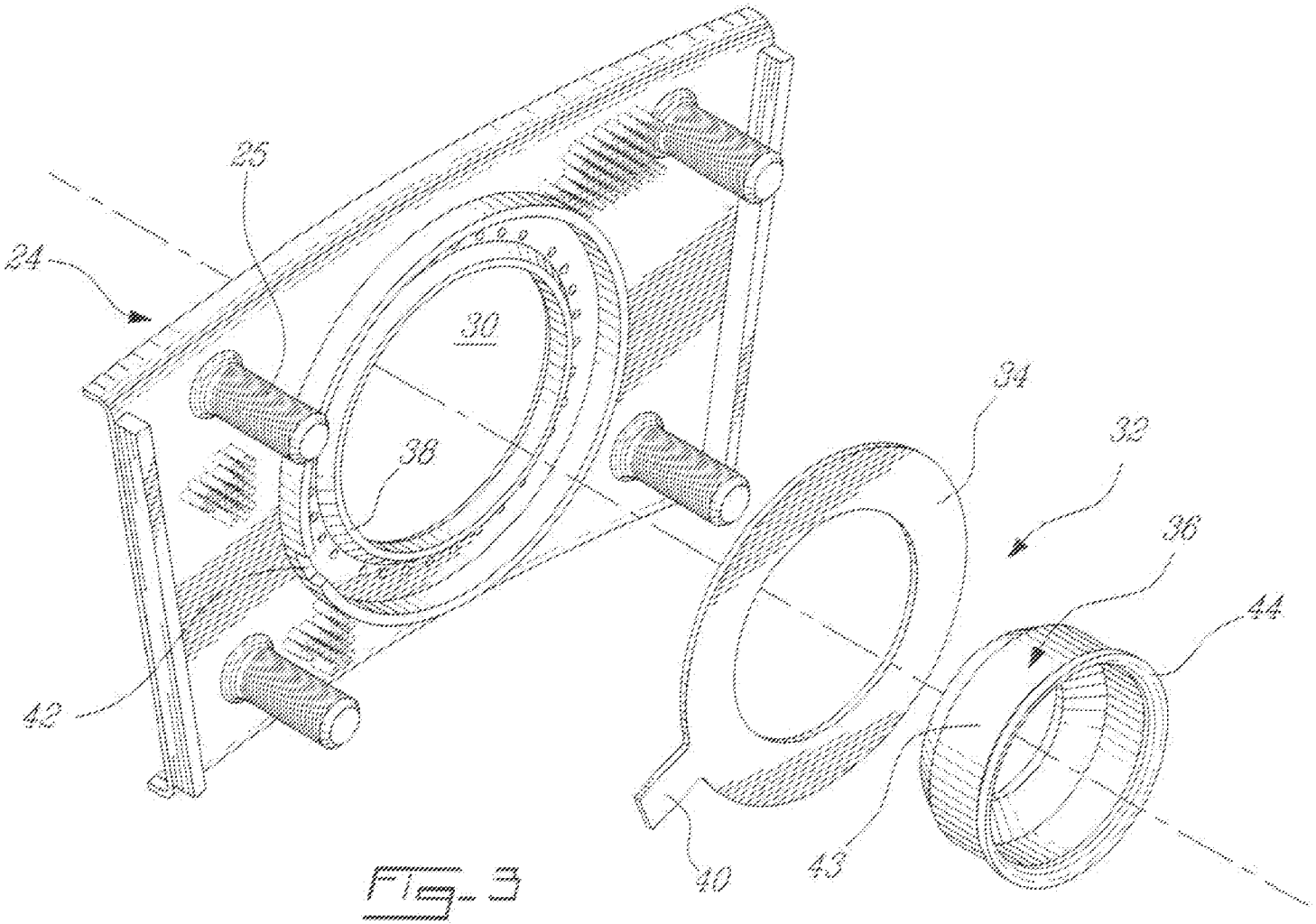

The combustor 16 is housed in a plenum 17 supplied with compressed air from compressor 14. The combustor 16 has a reverse flow annular combustor shell 20 including a radially inner liner 20*a* and a radially outer liner 20*b* defining a combustion, chamber 21. As shown in FIG. 2, the combustor shell 20 has a bulkhead or inlet dome portion 22 including an annular end wall or dome panel 22*a*. A plurality of circumferentially distributed dome heat shields (only one being shown at 24) are mounted inside the combustor 16 to protect the dome panel 22*a* from the high temperatures in the combustion chamber 21. The heat shields 24 can be provided in the form of high temperature resistant casting-made arcuate segments assembled end-to-end to form a continuous 360° annular band on the inner surface of the dome panel 22*a*. Each heat shield 24 has a plurality of threaded studs 25 (four in the example shown in FIG. 3) extending from a back face thereof and through corresponding mounting holes defined in the dome panel 22*a*. Fasteners, such as self-locking nuts, are threadably engaged on the studs from outside of the combustor 16 for securely mounting the dome heat shields 24 to the dome panel 22*a*. As shown in FIG. 2, the heat shields 24 are spaced from the dome panel 22*a* by a distance of about 0.1 inch so as to define an air gap 25. In use, cooling air is admitted in the air gap 25 via impingement holes (not shown) defined though the dome panel 22*a* in order to cool down the heat shields 24.

A plurality of circumferentially distributed nozzle openings (only one being shown at 26) are defined in the dome panel 22*a* for receiving a corresponding plurality of air swirler fuel nozzles (only one being shown at 28) adapted to deliver a fuel-air mixture to the combustion chamber 21. A corresponding central circular hole 30 is defined in each of the heat shields 24 and is aligned with a corresponding fuel nozzle opening 26 for accommodating an associated fuel nozzle 28 therein. The fuel nozzles 28 can be of the type generally described in U.S. Pat. No. 6,289,676 or 6,082,113, for example, and which are incorporated herein by reference.

As shown in FIG. 2, each fuel nozzle 28 is associated with a floating collar assembly 32 to facilitate fuel nozzle engagement with minimum air leakage while maintaining relative movement of the combustor 16 and the fuel nozzle 28. Each floating collar assembly 32 comprises a floating collar 34 axially sandwiched in the air gap 25 between a corresponding heat shield 24 and the dome panel 22*a*. The floating collar 34 defines a circular opening for allowing the collar to be axially slidably engaged on an axially extending nozzle cap 36, which is, in turn, fixedly mounted to a tip portion of an associated fuel nozzle 28. According to the illustrated embodiment, the floating collar 34 is provided in the form of a flat washer-like component having a front radially oriented surface which is in sealing contact with an associated sealing shoulder 38 (FIG. 3) extending integrally from the back face of the heat shield 24. Axial movement of the floating collar 34 is substantially restrained by the heat shield 24 and the dome panel 22*a* as the thickness of the floating collar 34 generally corresponds to the distance separating the heat shield 24 from the dome panel 22*a*. The skilled reader will however understand that slight axial movement may be allowed as there is no secure attachment between the heat shield 24 and the collar 34, or the dome panel and collar 34. Relative radial sliding movement is permitted between the floating collar 34 and the heat shield and the dome panel, assembly in order to accommodate thermal growth. The integrity of the seal maintained at all time by virtue of the radial sliding engagement of the floating collar 34 with the back face of the heat shield 24. As shown in FIG. 3, the floating collar 34 can be provided with an anti-rotation tang 40 for engagement in a corresponding slot 42 defined in a rib extending from the back face of the heat shield 24. Other anti-rotation arrangements could be used as well.

The floating collar 34 can be conveniently laser machined or otherwise reduced to its final shape from a simple flat sheet metal INCO 625. Other suitable materials could be used as well. According to the illustrated embodiment, no pressing or bending operation is required since the floating collar 34 is provided in the form of a two-dimensional or planar component free of any axial projection normally required to guarantee the integrity of the axial engagement between the fuel nozzle 28 and the floating collar 34. The floating collar and fuel nozzle engagement is rather maintained, during use, by the nozzle caps 36 mounted on the fuel nozzle tips.

Due to thermal expansion/contraction, the combustor 16 will move axially relative to the fuel nozzles 28. To accommodate this movement and ensure that the floating collars 34 remain sealingly engaged with the fuel nozzles 28 at all time, the fuel nozzles 28 have been equipped with a nozzle cap which has an axially extending cylindrical surface 43 over which each floating collar 34 is axially slidably engaged. The length of the cylindrical surface 43 is selected to ensure that the floating collars 34 will remain sealingly engaged on the fuel nozzles 28 at all time, regardless of the engine operating condition.

As shown in FIG. 2, the nozzle caps 36 are dimensioned to loosely fit within the nozzle openings 26 in the dome panel 22*a* and the corresponding central holes 30 in the heat shields 24. Excessive insertion of the fuel nozzles 28 into the nozzle openings 26 and the central holes 30 is prevented by a catch 44 provided at a trailing end portion of the nozzle cap 36. The catch 44 can be provided in the form of a radially extending shoulder which is oversized relative to the floating collar opening in order to prevent the cap 36 to pass through the floating collar 34 in case of a mechanical failure or during installation. It is understood that such a stopping shoulder does not have to extend along the full circumference of the nozzle cap 36.

It is noted that the cap 36 is externally mounted to the nozzle tip so as to not affect the fuel and air flow through the nozzle 28. The cap can be secured to the nozzle tip by any appropriate means as long as it provides an axially running surface for the floating collar 34. Alternatively, the axially running surface could be integrally provided on the fuel nozzle.

In use, the fuel nozzle nozzles 28 are positioned within the nozzle openings 26 and the central holes 30 for delivering a fuel air mixture to combustor 16. As forces acting upon the fuel nozzles 28 and the combustor 16 tend to cause relative movement therebetween, the floating collars 34 are able to displace radially with the nozzles while maintaining sealing with respect to combustor 16 through maintaining sliding engagement with dome heat shields 24 and nozzle caps 36.

The assembly process of the floating collar arrangement involves: fixing the nozzle caps 36 on the fuel nozzle tips, mounting the heat shields 24 to the dome panel 22*a* with the floating collars 34 axially trapped therebetween and with the anti-rotation tang 40 engaged in slot 42, and inserting the nozzle caps 36 in sliding engagement within the floating collar openings via the nozzle openings 26 defined in the dome panel 22*a*. As mentioned hereinabove, the catch 44 on the nozzle caps prevents the nozzle from being over-inserted into the combustor 16.

The provision of the axially extending cylindrical sliding surface on the nozzle rather than on the floating collar provides for the use of a simple flat floating collar and, thus, eliminates the needs for complicated forming or bending operations. The assembly of the floating collars 34 between the heat shields 24 and the dome panel 22*a* also contributes to minimize the number of parts required to install the floating collars. It also eliminates welding operations typically required to axially capture the floating collars between externally mounted brackets and caps. The present arrangement take advantage of the structure actually in place to trapped the floating collars.

The above description is meant to be exemplary only, and one skilled in the art will recognize that changes may be made to the embodiments described without departing from the scope of the invention disclosed. For example, the present invention may be applied to any gas turbine engine, and is particularly suitable for airborne gas turbine applications. The means by which the heat shields are mounted to the dome panel may be different than that described. The mode of anti-rotation may be any desirable. Other modifications which fall within the scope of the present invention will be apparent to those skilled in the art, in light of a review of this disclosure, and such modifications are intended to fall within the equivalents accorded to the appended claims.

The invention claimed is:

1. A floating collar and combustor arrangement for receiving a fuel nozzle, comprising:

a combustor having an opening defined in a dome thereof for receiving the fuel nozzle, the combustor having an inner surface and an outer surface;

a heat shield mounted to said dome inside said combustor at a distance from said inner surface, a floating collar axially trapped between the heat shield and the inner surface of the combustor such that relative axial movement is substantially restrained but relative radial movement is permitted, the floating collar having a central aperture substantially aligned with the opening in the dome; and a nozzle cap adapted to be mounted on said fuel nozzle for providing an axial interface between the floating collar and the fuel nozzle, the nozzle cap being axially moveable in said central aperture of said floating collar, said nozzle cap having axially spaced-apart leading and trailing end portions, and wherein said nozzle cap is provided at said trailing end portion with a catch which is adapted to abut said floating collar to prevent a tip of the fuel nozzle from being over-inserted into the combustor.

2. The floating collar and combustor arrangement of claim 1, wherein the floating collar is provided in the form of a substantially flat washer.

3. The floating collar and combustor arrangement of claim 1, wherein said nozzle cap has a peripheral cylindrical surface configured for sliding engagement in said central aperture of said floating collar.

4. The floating collar and combustor arrangement of claim 1, wherein said catch is provided in the form of a radial flange which is oversized relative to the central aperture of the floating collar.

5. The floating collar and combustor arrangement of claim 1, wherein said floating collar consists of a flat sheet metal ring having a radial surface and no axially projecting surface.

6. The floating collar and combustor arrangement of claim 1, wherein said floating collar is retained against rotation by said heat shield.

7. The floating collar and combustor arrangement of claim 6, wherein said floating collar has an anti-rotation tang engaged in a corresponding slot defined in a sealing shoulder extending from a back face of the heat shield.

8. A floating collar assembly for providing an interface between a fuel nozzle and a gas turbine engine combustor, the combustor having a dome and a heat shield mounted thereto, the dome defining a nozzle opening for receiving the fuel nozzle, the assembly comprising a floating collar adapted to be sandwiched between the dome and the heat shield for limited radial sliding movement with respect thereto, the floating collar defining an aperture substantially aligned with the nozzle opening when the floating collar is mounted between the heat shield and the dome, and a nozzle cap adapted to be mounted to the fuel nozzle, said floating collar being axially slidably engaged on said nozzle cap to permit relative movement between the fuel nozzle and the floating collar while providing sealing therebetween, said nozzle cap having a radial projection for limiting insertion of the fuel nozzle in the combustor.

9. The floating collar assembly of claim 8, wherein the floating collar is flat and free of any axially projecting surface.

10. The floating collar assembly of claim 8, wherein said aperture has an axial length equal to the thickness of said floating collar.

11. The floating collar assembly of claim 8, wherein said floating collar is provided in the form of an unbent annular sheet metal plate.

12. A floating collar arrangement for providing a sealing interface between a gas turbine engine combustor and a fuel nozzle tip, the combustor having a dome and a heat shield mounted thereto, the dome defining an opening for receiving the fuel nozzle tip, the arrangement comprising an axially extending cylindrical surface provided at the fuel nozzle tip, said axially extending cylindrical surface being insertable though the opening in the dome, and a substantially flat washer-like floating collar sealingly engaged on said axially extending cylindrical surface for relative axial movement with respect thereto when said substantially flat washer-like floating collar is trapped between the heat shield and the dome, wherein said axially extending cylindrical surface is provided with a catch to limit insertion of said fuel nozzle tip through said substantially flat washer-like floating collar.

13. A floating collar arrangement of claim 12, wherein said axially extending cylindrical surface is provided at the periphery of a nozzle cap adapted to be fixedly mounted to the fuel nozzle tip.

14. A method of mounting a floating collar assembly to a combustor having a dome panel and a heat shield mounted to the dome panel, the method comprising: axially trapping a floating collar between the heat shield and the dome panel of the combustor such as to substantially restrained axial movement of the floating collar while allowing relative radial movement, and inserting a fuel nozzle through the floating collar, the fuel nozzle having an axially extending peripheral surface having a length selected to maintain sealing engagement between the fuel nozzle and the floating collar when relative axial movement occurs between the fuel nozzle and the floating collar due to thermal expansion/contraction, the fuel nozzle having a catch limiting insertion of the fuel nozzle through the floating collar.

15. The method of claim 14, further comprising mounting a nozzle cap over the fuel nozzle, the axially extending peripheral surface defining an outline of said nozzle cap.

16. The method of claim 14, further comprising locking the floating collar against rotation relative to the heat shield.

* * * * *